US008943829B2

(12) United States Patent
Bagchi et al.

(10) Patent No.: US 8,943,829 B2
(45) Date of Patent: Feb. 3, 2015

(54) LEAN PREMIX BURNER OF A GAS-TURBINE ENGINE PROVIDED WITH A FLOW-GUIDING ELEMENT

(75) Inventors: Imon-Kalyan Bagchi, Berlin (DE); Waldemar Lazik, Teltow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 937 days.

(21) Appl. No.: 13/098,621

(22) Filed: May 2, 2011

(65) Prior Publication Data

US 2011/0271681 A1 Nov. 10, 2011

(30) Foreign Application Priority Data

May 7, 2010 (DE) ..... 10 2010 019 773

(51) Int. Cl.
*F23R 3/28* (2006.01)
*F23R 3/14* (2006.01)

(52) U.S. Cl.
CPC .. *F23R 3/286* (2013.01); *F23R 3/14* (2013.01)
USPC ..... 60/737; 60/743; 60/748

(58) Field of Classification Search
CPC ..... F23R 3/28–3/30; F23R 3/14; F23R 3/286; F23D 2900/11101
USPC ..... 60/743, 737, 748, 740, 742
See application file for complete search history.

(56) References Cited

U.S. PATENT DOCUMENTS

| | | | | |
|---|---|---|---|---|
| 3,483,699 | A * | 12/1969 | Harvey | 60/743 |
| 4,216,652 | A * | 8/1980 | Herman et al. | 60/748 |
| 4,689,961 | A * | 9/1987 | Stratton | 60/748 |
| 5,647,215 | A | 7/1997 | Sharifi et al. | |
| 5,647,538 | A | 7/1997 | Richardson | |
| 5,737,921 | A * | 4/1998 | Jones et al. | 60/748 |
| 6,547,163 | B1 * | 4/2003 | Mansour et al. | 239/404 |
| 7,621,131 | B2 | 11/2009 | Von Der Bank | |
| 8,607,571 | B2 * | 12/2013 | Williams et al. | 60/743 |
| 2002/0011064 | A1 * | 1/2002 | Crocker et al. | 60/748 |
| 2005/0039456 | A1 | 2/2005 | Hayashi | |
| 2006/0248898 | A1 | 11/2006 | Buelow | |
| 2007/0028619 | A1 * | 2/2007 | Spooner | 60/737 |
| 2009/0100837 | A1 | 4/2009 | Von Der Bank | |
| 2009/0173076 | A1 | 7/2009 | Toon | |
| 2009/0255258 | A1 * | 10/2009 | Bretz et al. | 60/737 |

FOREIGN PATENT DOCUMENTS

| | | |
|---|---|---|
| DE | 694 10 424 | 9/1998 |
| EP | 1445540 | 8/2004 |

OTHER PUBLICATIONS

German Search Report dated May 7, 2010 from counterpart application No. 10 2010 019 773.4.

* cited by examiner

*Primary Examiner* — Ted Kim
(74) *Attorney, Agent, or Firm* — Timothy J. Klima; Shuttleworth & Ingersoll, PLC

(57) ABSTRACT

This invention relates to a lean premix burner of a gas-turbine engine with an annular central body 2, which, while being essentially concentric to a burner center axis 1, is connected to a film applicator 3, which conically widens at the fuel exit side, as well as to an outer ring 4 concentrically arranged to the burner center axis 1 and surrounding at least the film applicator 3 at a certain distance, characterized in that an annular flow-guiding element 6 is provided in an annular duct 5 formed between the outer ring 4 and the film applicator 3 which, in the axial direction of the annular duct 5, is at least partly situated outside of the outer ring 4.

11 Claims, 4 Drawing Sheets

LEAN PREMIX BURNER OF A GAS-TURBINE ENGINE PROVIDED WITH A FLOW-GUIDING ELEMENT

The present invention relates to a lean premix burner of a gas-turbine engine in accordance with the features of the generic part of Claim 1.

More particularly, the present invention relates to a lean premix burner of a gas-turbine engine with an annular central body which, while being essentially concentric to a burner centre axis, is provided with an annular duct connected to a supply line and with a film applicator which conically widens at the fuel exit side and into whose radially inward area at least one fuel exit opening issues which is connected to the annular duct.

Combustion chambers of gas-turbine engines can be provided with lean premix burners in order to enable a fuel-air mixture with high content of air to be burned in the combustion chamber at low combustion temperature and with correspondingly reduced formation of nitrogen oxide. In order to ensure ignition of the lean air-fuel mixture under any condition, for example also at low ambient temperatures and correspondingly adverse vaporization behaviour, it is known to combine the lean burner (main burner) with a supporting burner, which is centrally integrated into the latter.

Furthermore, burners with an atomizer lip—also known as film applicator—are known, for example from Specification U.S. Pat. No. 6,560,964 B2. The annular atomizer lip, on which a continuous fuel film is generated, with the fuel film being acted upon by a concentric airflow, significantly enhances the atomization effect and the mixing of fuel and air.

Such burners can be provided with an annular atomizer lip having a circumferential fuel film application surface, as described in Specification EP 1 801 504, for example. A continuous fuel film is applied to the film application surface—uniformly distributed by supply ducts issuing at the film application surface—which is acted upon by a concentric airflow caused to swirl by swirler elements. This enables high atomization effect and intense mixture of air and fuel to be obtained.

However, as the film application surface is usually smooth, positive attachment of the fuel film is not fully ensured, i.e. the airflow, and thus the fuel film, may separate from the film application surface, in particular if the flow at the atomizer lip is retarded, i.e. has concave flow lines. This results in non-uniform, circumferentially streak or point-type fuel distribution. Moreover, separation of the flow and the fuel film from the film application surface of the atomizer lip will lead to turbulent instabilities which may give rise to compressive oscillations of high amplitude.

In a broad aspect, the present invention provides a design of a lean premix burner of the type mentioned at the beginning such that a stable, uniformly distributed fuel film is produced at the film application surface, which detaches uniformly at the flow-off edge and forms a fine droplet mist to ensure quiet combustion at low temperature, low nitrogen oxide formation and good combustion efficiency.

It is a particular object of the present invention to provide solution to the above problems by a combination of the features described herein. Advantageous embodiments of the present invention will become apparent from the present description.

According to the present invention, an annular flow-guiding element is therefore provided in the annular duct formed between an outer ring and the film applicator which, in the axial direction of the annular duct, is at least partly situated outside of the outer ring and/or the film applicator. In the direction of flow, the flow-guiding element therefore protrudes from the annular duct into the combustion chamber interior. Thus, the flow-guiding element provides an aerodynamic flow field by way of which fuel atomisation is enhanced. This is effected by directly conducting the flow used for atomization, improving the flow along the film applicator.

The flow-guiding element according to the present invention can be provided in a wide variety of forms and arrangements, depending on the respective type of lean pre-mix burner. Here, it is particularly favourable if the flow-guiding element is disposed downstream of a swirler element. The swirler element is, for example, provided in the annular duct upstream of the flow-guiding element. However, it may also be arranged radially inwards or radially outwards immediately adjacent to the flow-guiding element.

It is particularly favourable if the flow-guiding element is cross-sectionally provided with a convex contour showing radially towards the burner centre axis, while the opposite side is preferably provided with a concave contour. Thus, the flow-guiding element is fluidically optimized and cross-sectionally flow-favourable, such as the airfoil profile of an aircraft wing. Accordingly, an underside facing the film applicator is provided at which a lower pressure exists, as a result of which the flow conducted along the film applicator is accelerated together with the fuel droplets. Thus, good atomization of the fuel is effected. The rear-side flow (radially on the outside) of the flow-guiding element provides for improved total flow through the burner.

It is particularly favourable if the flow-guiding element is provided with a cross-section widening in flow direction. The resultant angle to the burner centre axis can thus be equal to the opening angle of the burner, providing for constant widening and, thus, favourable flow, along the film applicator and, in the direction of flow, along the flow-guiding element. In a preferred development of the present invention, the opening angle of the flow-guiding element can be slightly larger than the opening angle of the film applicator. This provides for improved ignition characteristics.

The length of the flow-guiding element protruding beyond the plane of the film applicator, relative to a plane which is located vertically to the burner centre axis and in which the flow-off edge of the film applicator is situated, provides for fluidic as well as mechanical protection of the lip of the film applicator.

Owing to the circular ring shape of the flow-guiding element, the swirl direction of the flow remains unaffected, so that optimized flow conditions can be ensured.

According to the present invention, the flow-guiding element can be mounted on the outer ring, with mounting on the film applicator or on a heat shield surrounding the latter also being possible. The flow-guiding element can be mounted by means of aerodynamically shaped struts. With such struts, a non-swirled flow is obtainable on the mounting side of the flow-guiding element, providing there for improved flow and enhanced atomization.

The present invention is more fully described in light of the accompanying drawing showing preferred embodiments. In the drawing, FIG. 1 is a simplified partial sectional view of an embodiment of the lean premix burner in accordance with the present invention, FIG. 2 is an enlarged detail view of the area marked in FIG. 1, and FIGS. 3-8 show modified exemplary embodiments of the flow-guiding element in a view analogically to FIG. 2.

The lean pre-mix burner shown in FIG. 1 has a burner centre axis 1 relative to which the components are essentially concentrically arranged. The lean pre-mix burner features a supporting burner 13 which corresponds to the state of the art and to which fuel is supplied via a fuel line 14. The supporting burner 13 is surrounded by swirler elements 15, as known from the state of the art. Disposed centrically to the supporting burner 13 is a flame stabilizer 16 which again corresponds to the state of the art so that a detailed description can here be dispensed with. Also, at least one swirler element 17 is arranged radially outside of the flame stabilizer 16. Radially outside of the swirler element 17 and concentrically to the burner centre axis 1, the lean pre-mix burner according to the present invention has an annular central body 2 in which a supply line 18 for fuel is provided. The supply line 18 issues into an annular duct 19 enabling fuel to issue through at least one fuel exit opening 20.

The annular central body 2 forms a cone-shaped film applicator 3 widening radially outwards in the direction of flow. Showing radially inwards, a film application surface axially terminating at an atomizer lip 12 (flow-off edge) is provided on the film applicator 3.

Arranged radially outside of the film applicator 3 or, respectively, the annular central body 2 is at least one swirler element 7 which is radially outwards confined by an outer ring 4.

An annular duct 5 is provided between the outer ring 4 and the central body 2, with a heat shield 9 being interposed, if applicable. Disposed in this annular duct 5 is the swirler element 7. Arranged downstream of the swirler element (see embodiment of FIG. 2) is an annular flow-guiding element 6. This flow-guiding element 6 is mounted on the outer ring 4 by means of struts 21 which may have a fluidically optimized cross-section.

The annular flow-guiding element 6 has an airfoil-type cross-section, as shown in FIG. 2, for example. Accordingly, a radially outward, concave side is provided, with the radially inward side being convex. Resulting therefrom is an acceleration of the flow passing the radially inward, convex contour 8. This flow mixes with the film applicator flow 22 and produces an underpressure, as a result of which the fuel exiting from the fuel opening 20 is accelerated together with the film applicator flow 22 and its atomization improved.

FIGS. 3 to 8 show modified detail solutions. Here, FIG. 3 is a representation analogically to FIG. 2 in which, in particular, the opening angle of the flow-guiding element 6 is essentially equal to the opening angle of the film applicator 3, with the flow-guiding element 6, however, having a larger diameter.

In the embodiment shown in FIG. 4, the flow-guiding element 6 is mounted radially inwards on the heat shield 9 by means of struts.

FIG. 5 shows a modified embodiment in which the flow-guiding element is mounted on the outer ring 4 by means of outer struts 21 and features a swirler element 10 arranged on its radially outer side. No struts are provided downstream of the flow-guiding element 6. Thus, a non-swirled airflow is obtained on the inner side of the flow-guiding element by which atomization is improved. Here, the airflow has higher dynamic pressure, with the entire pressure drop occurring over the air passage, without losses at the struts. Thus, good homogeneity of fuel atomization in the circumferential direction is achieved.

The embodiment in FIG. 6 shows a form of the flow-guiding element 6 which is elongated in the direction of flow. It is provided on both sides with a swirler element 10 and 11, respectively. This enables velocity distributions beyond or beneath the flow-guiding element to be specifically controlled.

LIST OF REFERENCE NUMERALS

Figure 1:
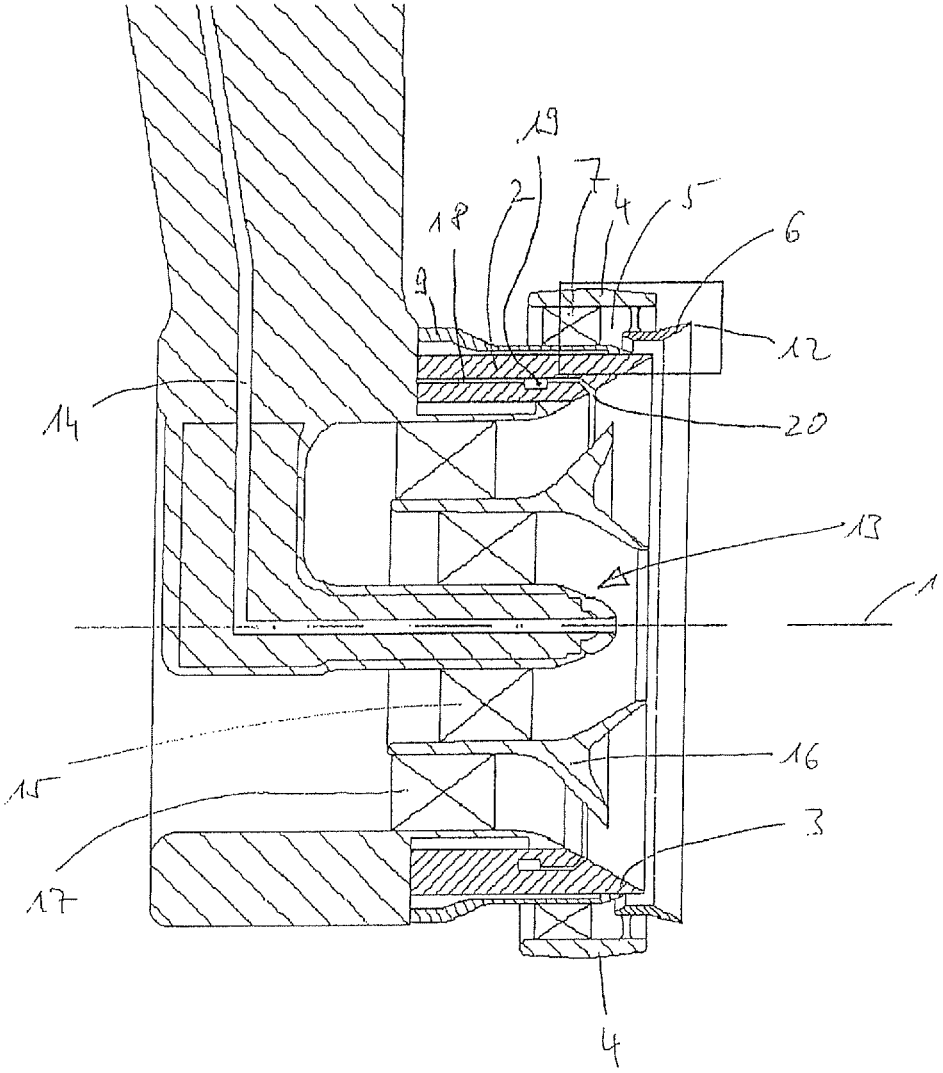
Figure 2:
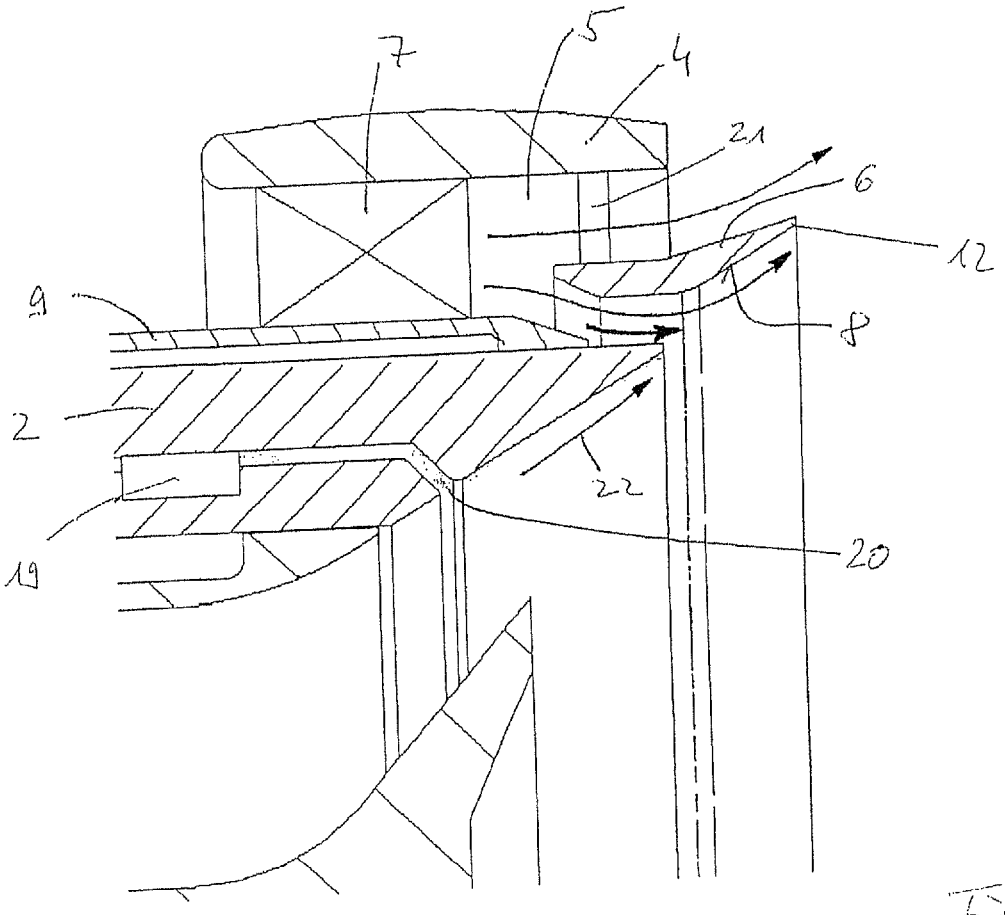
Figure 1:
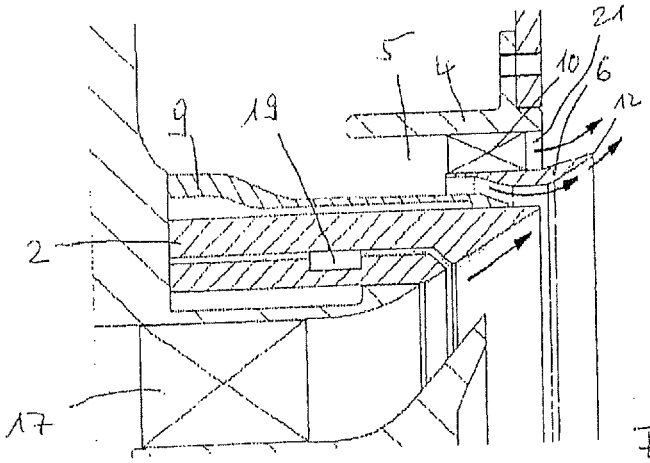
Figure 3:
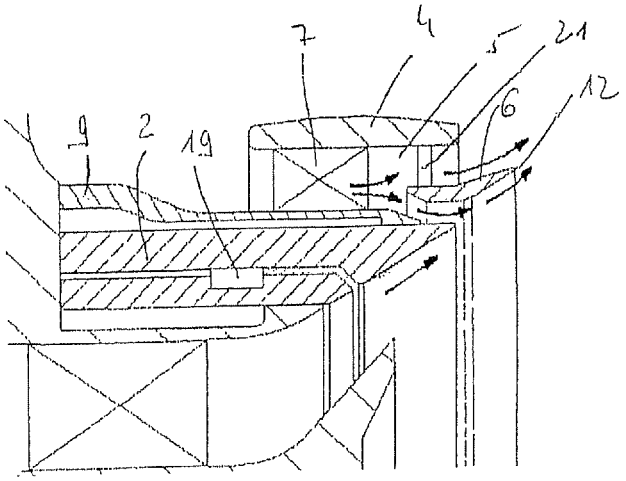
Figure 4:
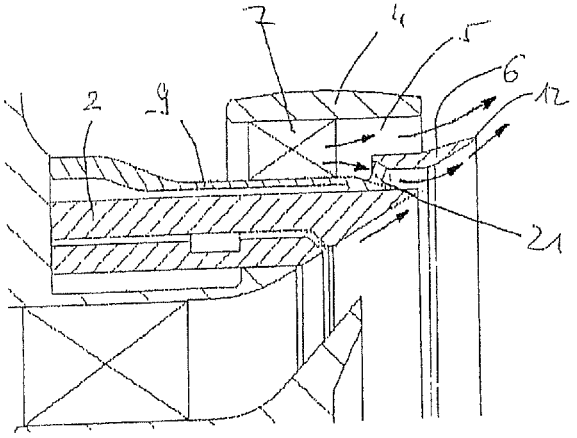
Figure 6:
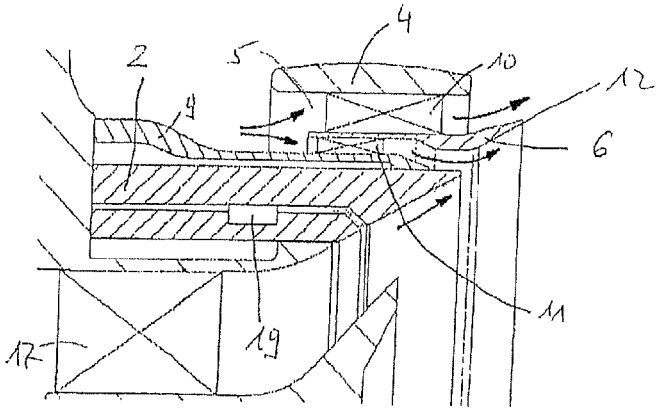
Figure 7:
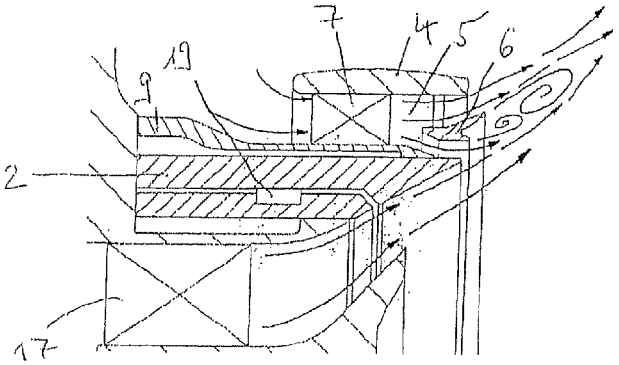
FIG. 7 shows an embodiment in which the trailing-end side of the flow-guiding element is cross-sectionally forked, resulting in two flow-off edges. Thus, a swirling zone between the two flows is provided leading to increased dispersion of the spray, as shown in FIG. 7.
Figure 8:
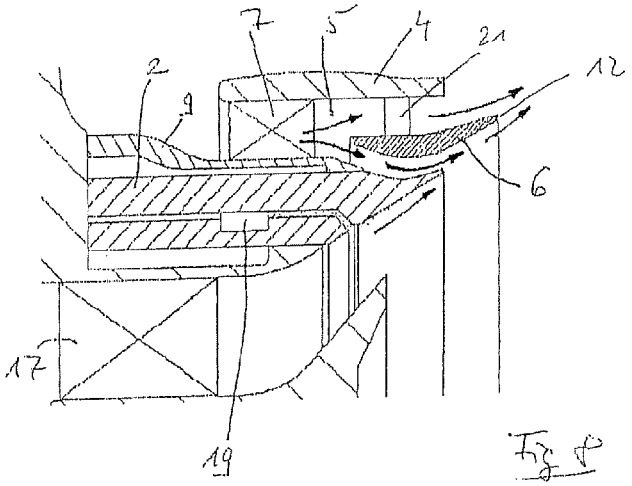
FIG. 8 shows a further embodiment analogically to FIG. 3. Here, the thinner cross-section of the flow-guiding element leads to heating of the fuel in the direction of the atomizer lip/flow-off edge 12, thereby improving film formation and atomization.

1 Burner centre axis
2 Central body
3 Film applicator
4 Outer ring
5 Annular duct
6 Flow-guiding element
7 Swirler element
8 Convex contour
9 Heat shield
10 Swirler element
11 Swirler element
12 Flow-off edge/atomizer lip
13 Supporting burner
14 Fuel line
15 Swirler element
16 Flame stabilizer
17 Swirler element
18 Supply line
19 Annular duct
20 Fuel exit opening
21 Strut
22 Film applicator flow

What is claimed:

1. A lean premix burner of a gas-turbine engine, comprising:

an annular central body being essentially concentric to a burner center axis, a film applicator having a conical film application surface for supplying with fuel from a fuel exit opening, the film application surface having a fuel flow off edge at a downstream area; the film application surface conically widening between a conical surface upstream of the fuel exit opening and to the fuel flow off edge of the film applicator;

an outer ring concentrically arranged to the burner center axis and surrounding at least the film applicator at a certain distance to form an annular duct between the outer ring and the film applicator;

wherein the annular central body is connected to the film applicator and to the outer ring;

an annular flow-guiding element provided in the annular duct between the outer ring and the annular central body having a downstream portion extending in an axial direction downstream of a downstream-most edge of the outer ring.

2. The lean premix burner in accordance with claim 1, wherein the flow-guiding element is disposed downstream of a swirler element provided in the annular duct.

3. The lean premix burner in accordance with claim 1, wherein the flow-guiding element includes a convex contour showing radially towards the burner center axis.

4. The lean premix burner in accordance with claim 1, wherein the flow-guiding element is mounted on the outer ring.

5. The lean premix burner in accordance with claim 1, wherein the flow-guiding element is mounted on at least one chosen from the film applicator and a heat shield surrounding the film applicator.

6. The lean premix burner in accordance with claim 1, wherein a radially outward side of the flow-guiding element is concave.

7. The lean premix burner in accordance with claim 1, and further comprising a swirler element arranged on the flow-guiding element on at least one chosen from a radially inner side and a radially outer side of the flow-guiding element.

8. The lean premix burner in accordance with claim 1, wherein the flow-guiding element includes a single flow-off edge on a trailing-end side of the flow-guiding element.

9. The lean premix burner in accordance with claim 1, wherein the flow-guiding element includes a plurality of flow-off edges on a trailing-end side of the flow-guiding element.

10. The lean premix burner in accordance with claim 1, wherein the flow-guiding element includes a cross-section widening in a flow direction.

11. The lean premix burner in accordance with claim 1, and further comprising an annular flame stabilizer surrounding the burner center axis and positioned between the burner center axis and the film applicator, with the flame stabilizer having a V-shape in annular cross-section with the V-shape spreading outward in a downstream direction.

* * * * *